US008689774B1

(12) United States Patent
Ritz

(10) Patent No.: US 8,689,774 B1
(45) Date of Patent: Apr. 8, 2014

(54) CROSSBOW AND COMPONENTS ATTACHED BY A SLIDING JOINT ASSEMBLY

(75) Inventor: Gregory J. Ritz, Stratham, NH (US)

(73) Assignee: Hunter's Manufacturing Company, Suffield, OH (US)

( * ) Notice: Subject to any disclaimer, the term of this patent is extended or adjusted under 35 U.S.C. 154(b) by 271 days.

(21) Appl. No.: 13/106,911

(22) Filed: May 13, 2011

(51) Int. Cl.
*F41B 5/12* (2006.01)

(52) U.S. Cl.
USPC ..... 124/25

(58) Field of Classification Search
USPC ..... 124/25
See application file for complete search history.

(56) References Cited

U.S. PATENT DOCUMENTS

| | | | | |
|---|---|---|---|---|
| 5,115,795 | A * | 5/1992 | Farris | 124/86 |
| 7,100,590 | B2 * | 9/2006 | Chang | 124/25 |
| 7,455,059 | B2 * | 11/2008 | Shaffer | 124/25 |
| 7,506,643 | B2 * | 3/2009 | Holmberg | 124/86 |
| 2009/0277435 | A1 * | 11/2009 | Pestrue | 124/25 |

* cited by examiner

*Primary Examiner* — John Ricci
(74) *Attorney, Agent, or Firm* — Emerson Thomson Bennett

(57) ABSTRACT

A stock is attached to a recoil pad or a crank assembly by a sliding joint assembly. The stock includes one portion of the sliding joint assembly and the recoil pad and crank assembly include the other portion of the sliding joint assembly. The portions of the sliding joint assembly have complementary shapes, such as a tongue and a slot.

15 Claims, 11 Drawing Sheets

CROSSBOW AND COMPONENTS ATTACHED BY A SLIDING JOINT ASSEMBLY

TECHNICAL FIELD

The present invention relates to the archery field. More particularly, the present invention relates to a system for attaching components to the stock of a crossbow.

BACKGROUND ART

Cocking archery bows involves moving the bow string from an uncocked position to a cocked position, which can be difficult in that a variable amount of work can be required to move the bow string to the cocked position. A bow's draw weight is the peak amount of weight an archer will encounter while drawing the bow into the cocked position. While bows for children have a low draw weight, around ten to twenty pounds, performance bows and bows used for hunting can have substantial draw weights. For example, draw weights in excess of fifty pounds are typical for traditional and compound style bows. Crossbows, however, often have draw weights in the range of one-hundred to two-hundred pounds, and are therefore some of the most difficult bows to cock.

Devices to make cocking a crossbow easier are available in the market. An example of such a device is a cocking rope, which is sometimes referred to in the industry as a "block and tackle." A cocking rope introduces the mechanical advantage of a pulley system into cocking the crossbow, thereby decreasing the peak amount of weight the archer must pull when moving the bowstring to the cocked position. However, a cocking rope may be ineffective for some archers, as the archer cannot pause before reaching the cocked position in the cocking process without returning the bowstring to the uncocked position. Moreover, even if the draw weight is reduced by half, this may still be excessive for some archers. In addition, the most practical way to use a cocking rope is in a traditional crossbow-cocking position, where the archer's foot is placed into the stirrup on the crossbow, and the archer bends over toward the stirrup to pull the bowstring upward. But bending and pulling in such position may be challenging or impossible for some archers.

Another device designed to make cocking easier is a crank. Crossbow-cocking cranks are known and are typically of the ratcheting type, which lock after each advancement interval. Cranks represent an improvement over cocking ropes, because an archer can operate the crank and move the bowstring part-way to the cocked position, and then pause without the bowstring returning to the uncocked position. In addition, cranks remove the necessity for bending over and pulling a cocking rope and a crossbow can be cocked from many positions, including on a tabletop. However, because of the substantial draw weights associated with crossbows, a crank must be securely fastened to the crossbow to be safe and effective. While designs for attaching cranks to crossbows are known, many of them are aesthetically and functionally unappealing. For example, some designs have the crank permanently attached to a crossbow, but these have been regarded as adding unwanted weight and as being bulky and cumbersome. Removable crank designs are available, but these have varying degrees of ease of installation and removal.

Thus, a need exists in the art for devices that make cocking a crossbow easier, are well designed, and are easy to install and remove, and for crossbows that work with such devices.

DISCLOSURE OF THE INVENTION

In light of the foregoing, it is an object of one aspect of the present invention to provide a crossbow which allows components to be attached to the crossbow by a sliding joint assembly.

It is an object of another aspect of the present invention to provide a crossbow, as above, having stock having a first portion of a sliding joint assembly, the first portion being adapted to engage a second portion of the sliding joint assembly carried by a cocking assembly to thereby attach the cocking assembly to the stock.

These and other objects of the present invention, as well as the advantages thereof over existing prior art forms, which will be apparent from the description to follow, are accomplished by the improvements hereinafter described and claimed.

In general, a stock constructed according to the concepts of the present invention is adapted to be connected to another item having a first portion of a sliding joint assembly. The stock includes a butt end, and a second portion of the sliding joint assembly is formed at the butt end. The second portion is adapted to engage the first portion on the other item.

In these or other embodiments, a crossbow for use with a component having a first portion of a sliding joint component includes a stock having a butt end. A second portion of the sliding joint component is formed on the butt end.

In even other embodiments, a crank assembly for use with a crossbow stock having a first portion of a sliding joint assembly includes a second portion of the sliding joint assembly. The second portion is adapted to engage the first portion to form the sliding joint assembly.

In even other embodiments, a component for use with a stock having a first portion of a sliding joint assembly includes a second portion of the sliding joint assembly. The second portion is adapted to engage the first portion and form the sliding joint assembly.

A preferred exemplary crossbow according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
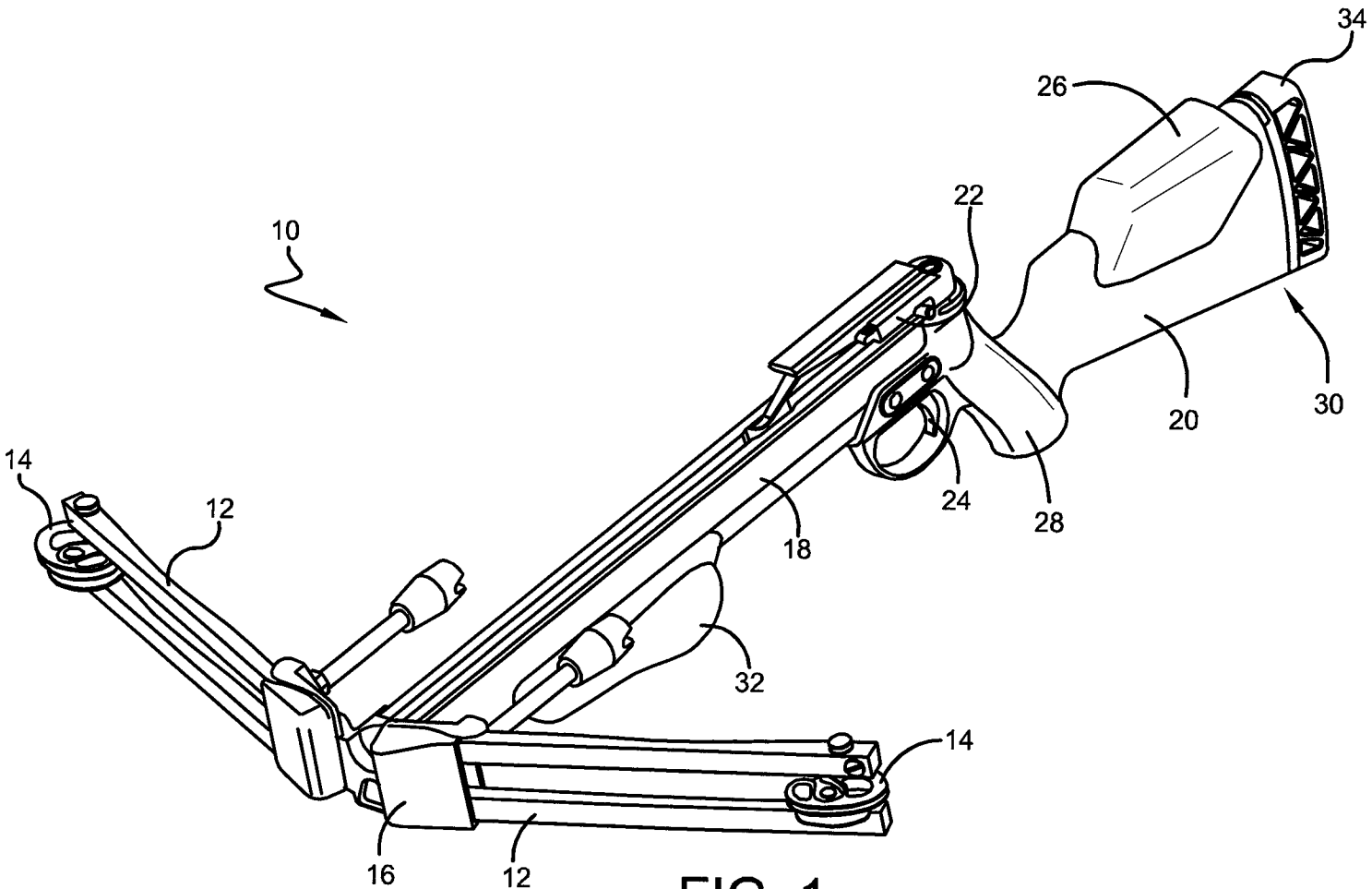
FIG. 1 is a somewhat schematic top, front perspective view of a crossbow having features of the present invention.
Figure 2:
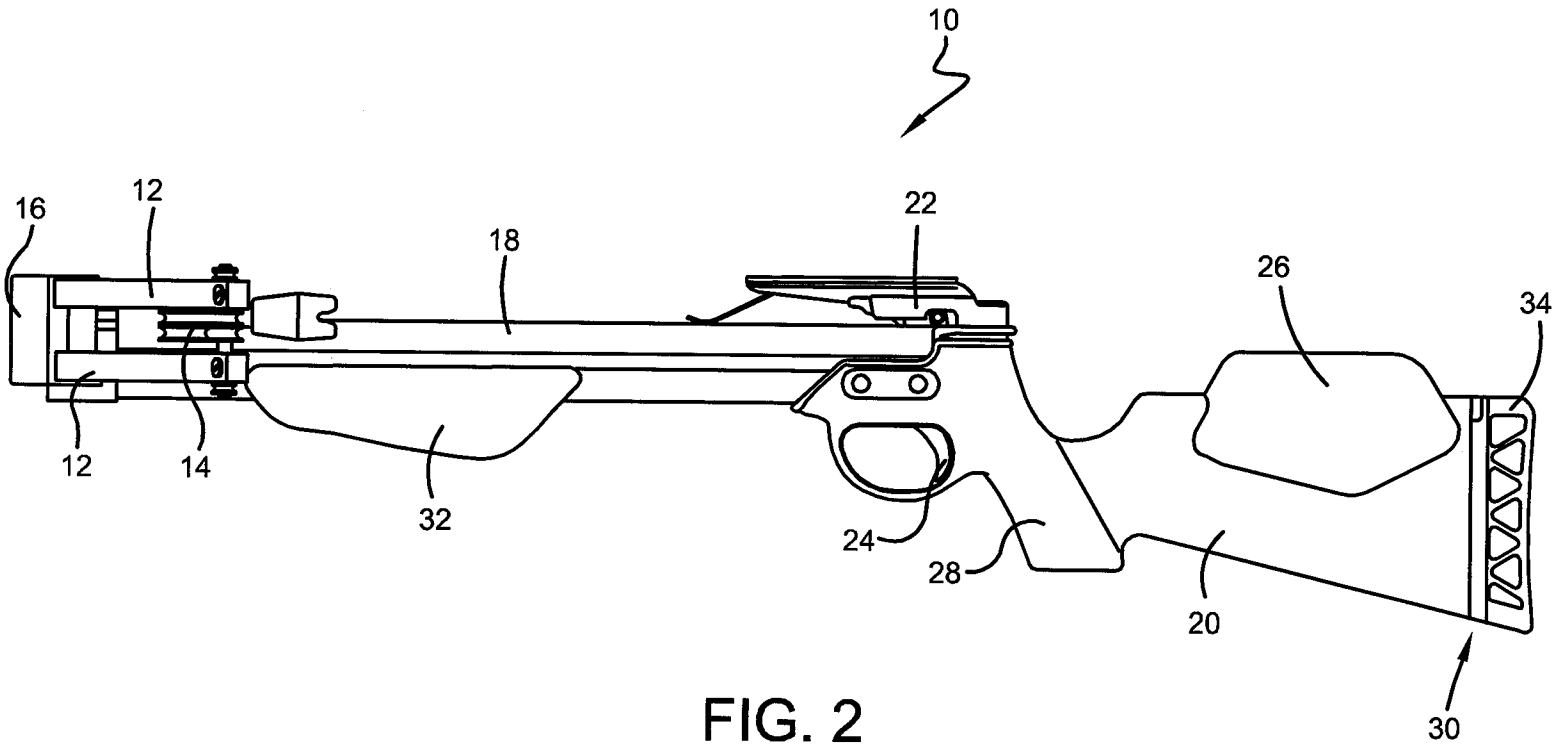
FIG. 2 is a side elevation view of the crossbow.

A crossbow having features of the present invention is generally indicated by the numeral 10. Crossbow 10 has many components common to crossbows including limbs 12, cams 14, a riser 16, a barrel 18, a stock 20, a latching mechanism 22, and a trigger 24. Some crossbows may have modified versions of, or may not include, some of the general crossbow components discussed above, but regardless, the essential purposes and structural features of such components are well known in the art.

Stock 20 includes a comb (cheek rest) 26 and a grip portion 28, and extends from a grip portion 28 positioned near the trigger 24 to a butt end 30. A fore-end grip 32 is provided on barrel 12 between latching mechanism 22 and riser 16, and provides a location for an archer to grip crossbow 10, particularly when it is positioned in the shooting position. Generally, stocks support the barrel and the firing mechanisms in a crossbow, and provide a means for an archer to support and aim the crossbow. Other stock shapes than that shown herein are available and may be suitable for use in the present invention, including those stocks that extend from a butt end to a fore-end, the fore-end being forward of the trigger, and in some cases between the trigger and the riser.

A recoil pad 34 is provided on the butt end 30 of stock 20. Recoil pad 34 is removably attached to stock 20 in a manner to be hereinafter described. Recoil pads are known in the art and offer padding for when a crossbow is placed into the firing position and the recoil pad is brought into contact with the archer's shoulder. Also, recoil pads offer damping of the recoil impulse when shooting the crossbow. Recoil pads, including recoil pad 34, may vary in size and construction depending on an archer's needs or preferences. For example, an archer with long arms may use a longer recoil pad, thereby effectively increasing the length of the stock and putting the trigger into a more desirable position with respect to the archer's body (also known as the length of pull). As will be hereinafter described, recoil pad 34 may include the same structural features as the crank assembly for attaching the same to the stock 20 using a sliding joint assembly.

Figure 3:
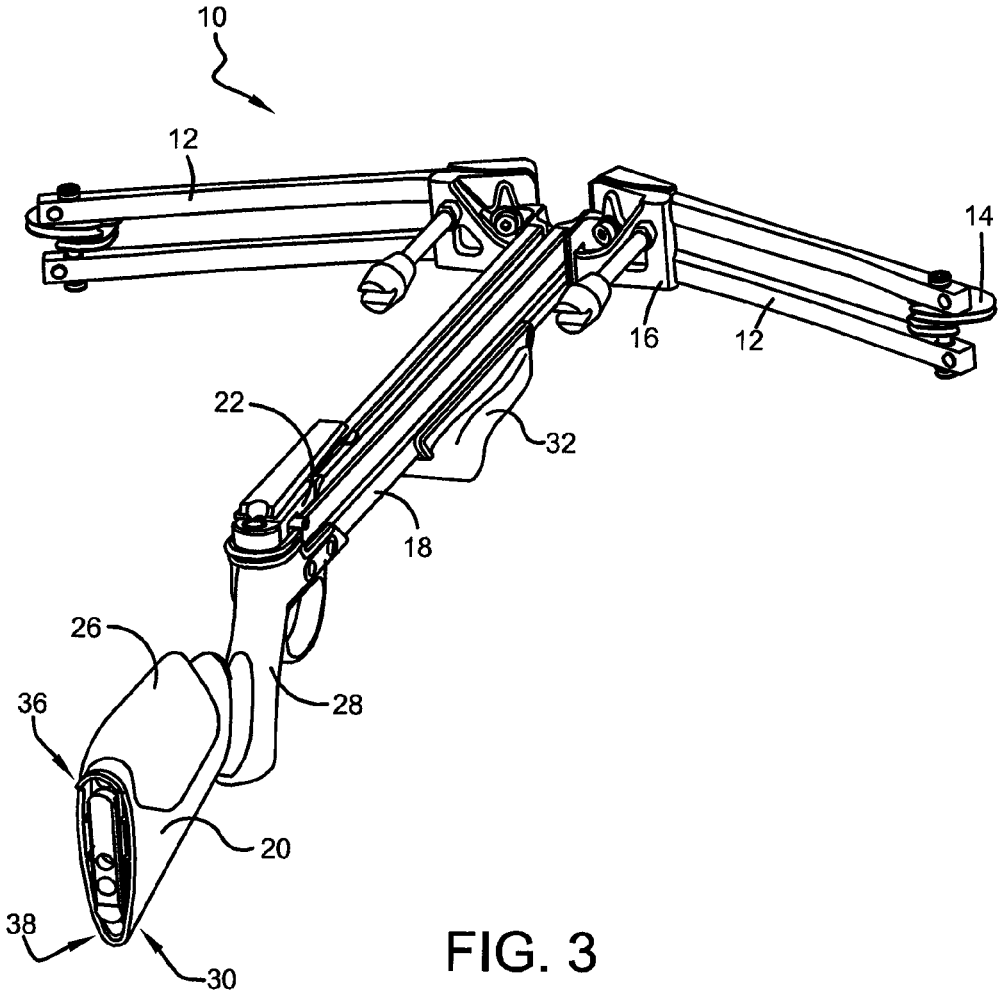
FIG. 3 is a somewhat schematic top, rear perspective view showing the crossbow with the recoil pad removed.
Figure 4:
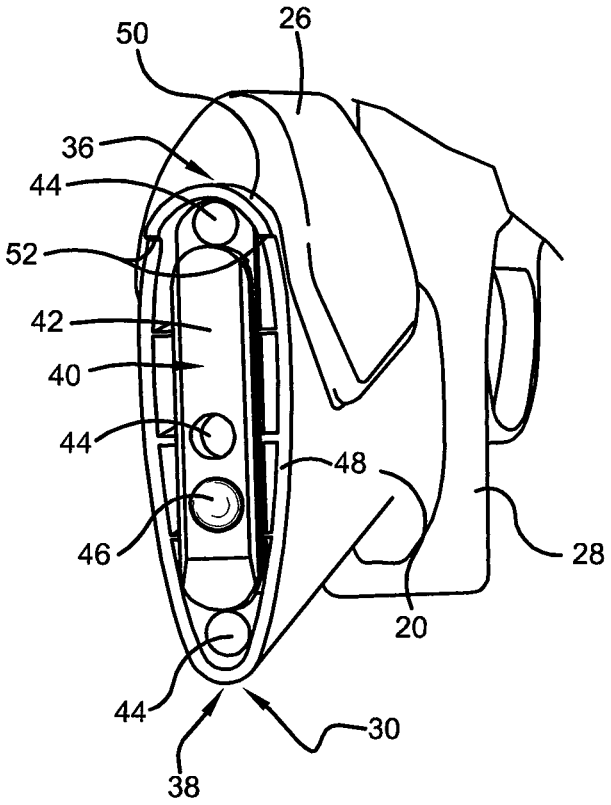
FIG. 4 is a rear perspective view of a portion of the stock of the crossbow.
Figure 5:
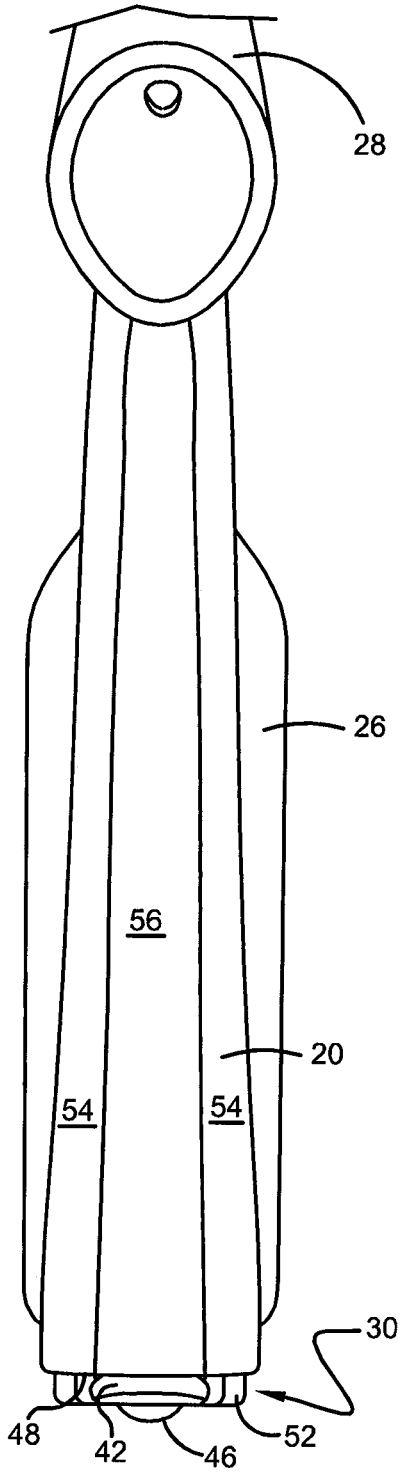
FIG. 5 is a bottom plan view of a portion of the stock of the crossbow.

Crossbow 10 is shown in FIGS. 3 and 4 with recoil pad 34 removed from the butt end 30 of stock 20. The butt end 30 extends generally in the height direction from a heel region 36 to a toe region 38. Butt end 30 includes a sliding joint assembly plate 40 which includes the tongue portion 42 of the sliding joint assembly. Plate 40 may be attached to stock 20 using screws through holes 44, or by any other suitable means. A ball catch 46 is provided in tongue portion 42, and includes a ball portion under spring tension for mating with a corresponding recess in another component (such as, in the recoil pad 34, which attaches to stock 20 through tongue portion 42). Butt end 30 also includes a sliding surface 48 and a rearwardly extending protrusion 50 proximate the heel region 36. Protrusion 50 defines an overhang 52, and sliding surface 48 extends downwardly therefrom to toe region 38. As shown in FIG. 5, stock 20 generally includes side surfaces 54 and a bottom surface 56, though surfaces 54 and 56 transition smoothly to one another. Tongue portion 42 of plate 40 and overhang 52 extend rearwardly outward of butt end 30, beyond sliding surface 48.

Figure 6A:
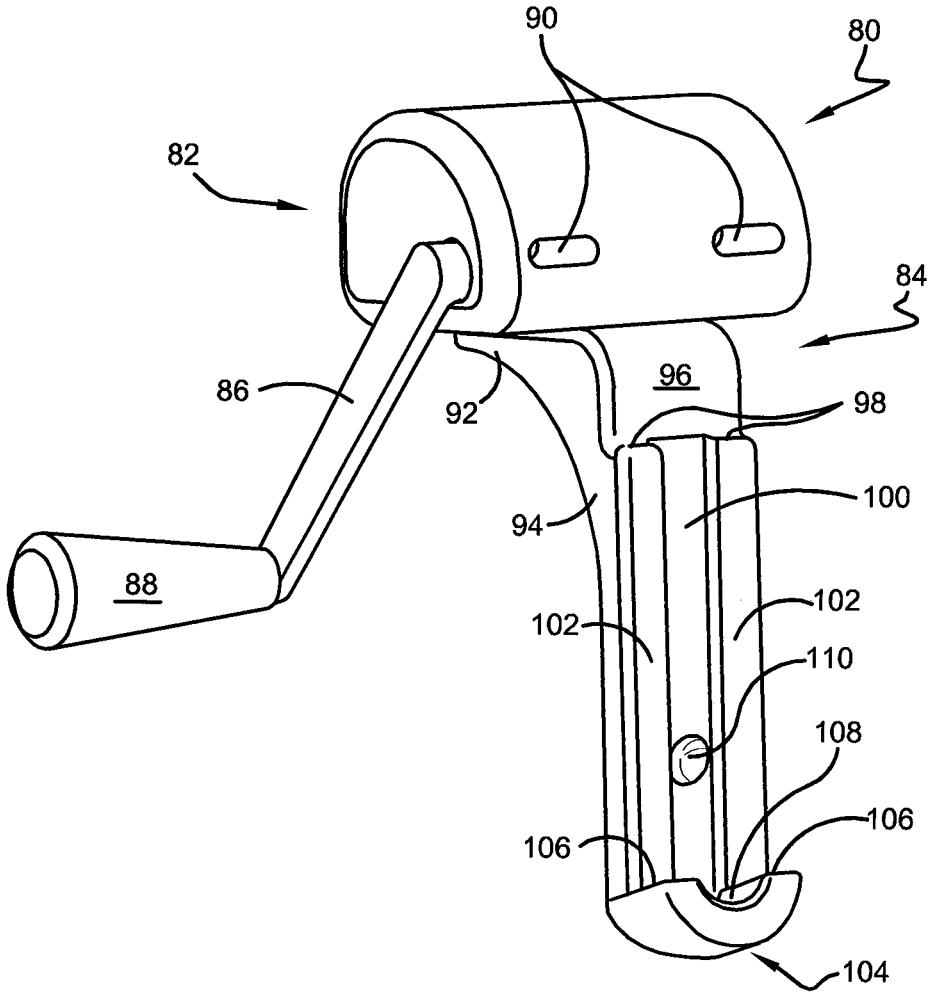
FIG. 6A is a perspective view of a crossbow-cocking crank assembly having features of the present invention.
Figure 6B:
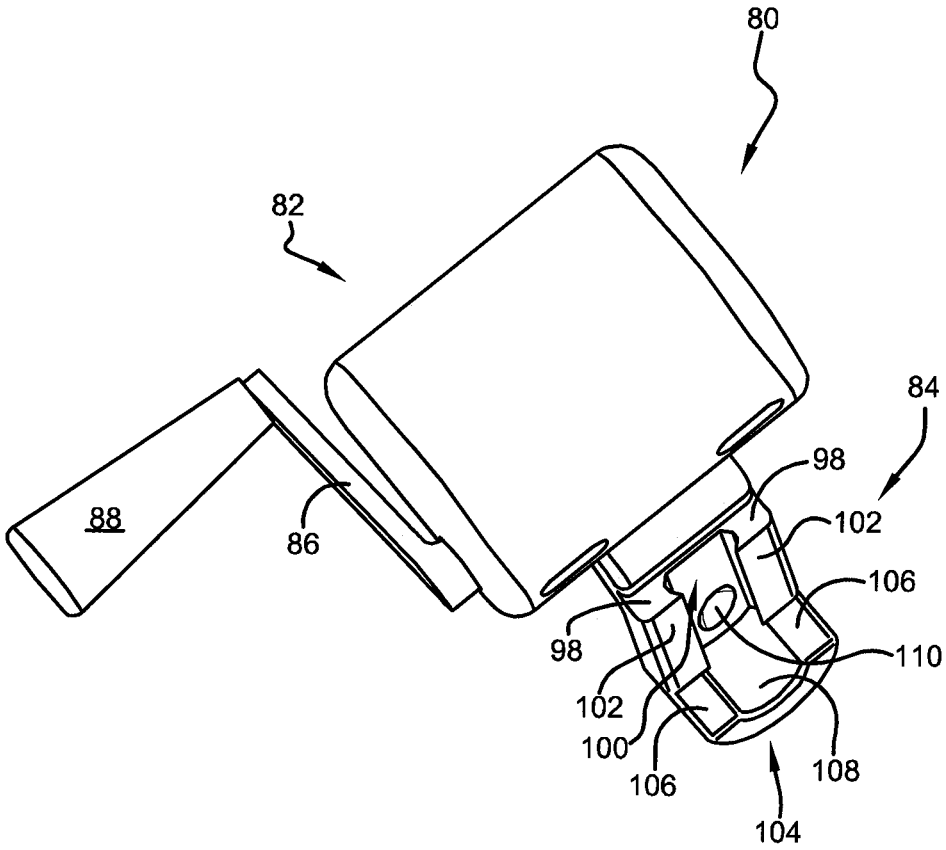
FIG. 6B is another perspective view of the crank assembly of FIG. 6A.
Figure 7A:
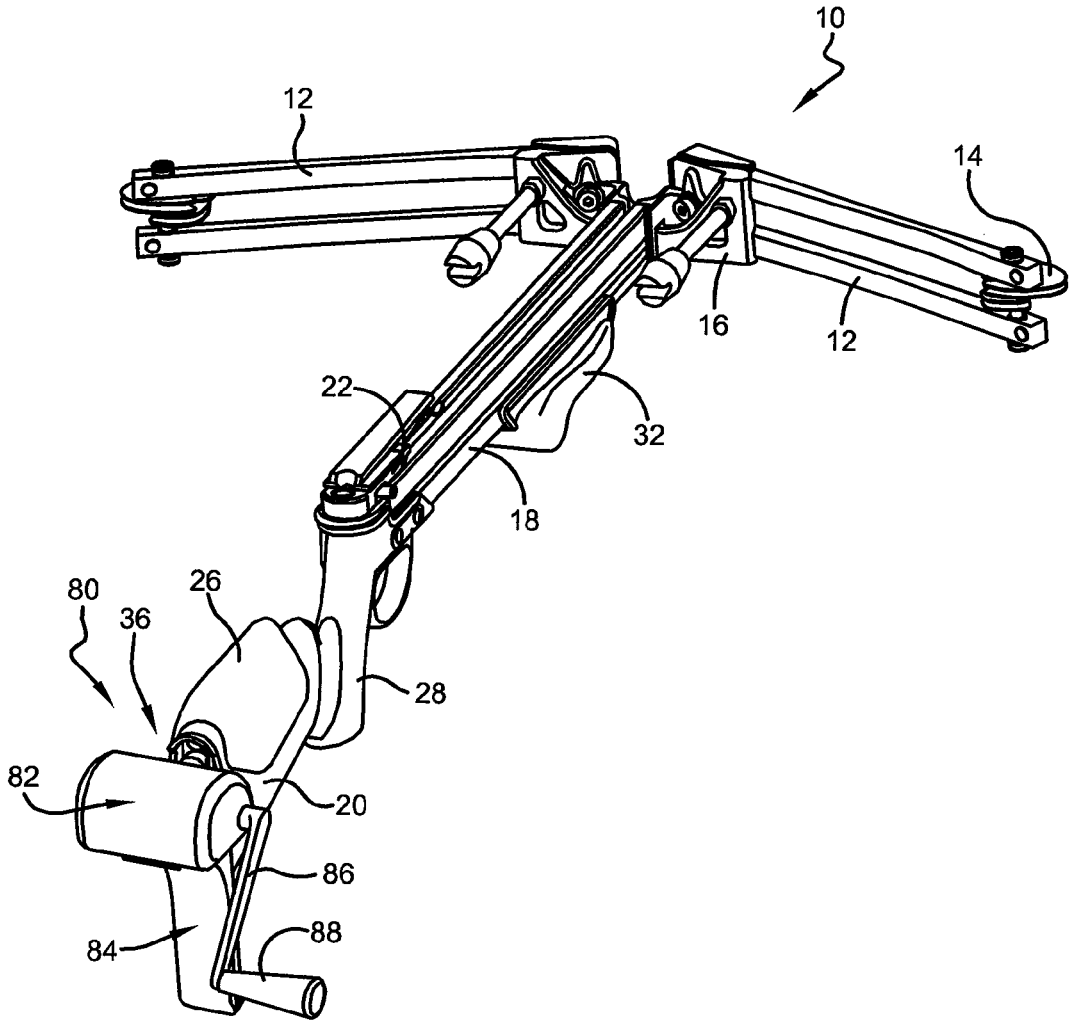
FIG. 7A is a top-rear perspective view showing the crank assembly of FIGS. 6A and 6B partially installed on the stock of the crossbow of FIG. 1.
Figure 7B:
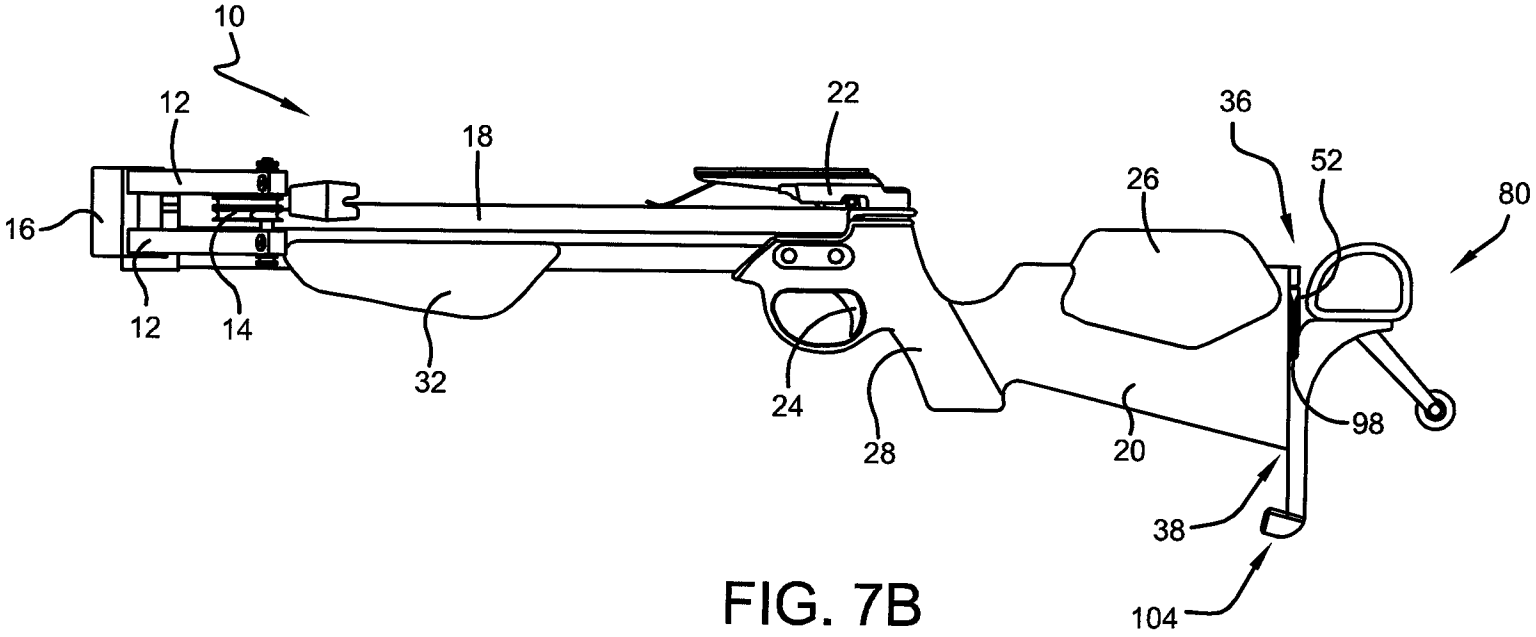
FIG. 7B is a side elevational view of the crossbow shown in FIG. 7A.

A crank assembly, generally indicated by the numeral 80, is shown in FIGS. 6A and 6B. Crank assembly 80 includes two main components: Crank 82 and attachment body 84. Crank 82 can be any useful type of crank, including a ratcheting crank, and includes a crank arm 86 and a handle 88. As shown, crank 82 includes openings 90, out of which can extend crank leads (not shown) for attaching to and pulling on the bowstring of crossbow 10. The use of such cranks in cocking a crossbow is generally well understood to those skilled in the art.

Attachment body 84 includes a crank arm 92 for supporting crank 82. A sliding joint assembly arm 94 extends from crank arm 92 and supports or includes a portion of a sliding joint assembly (the complementary shaped portion to what is provided on stock 20) for connecting the crank assembly 80 to the stock 20 of crossbow 10. Arm 94 includes a surface 96 with ledges 98 extending therefrom, and separated by a slot 100 provided in arm 94. The shape of slot 100 is designed to correspond with the shape of tongue 42 on stock 20. Thus, the tongue 42 may be slidably received in slot 100. Sliding surfaces 102 extend downwardly from ledges 98 to an end stop 104 which includes a planar stop surface 106 and a curved stop surface 108. Arm 94 also includes a recess 110 for mating with the ball of the ball catch 46 incorporated into tongue 42 on stock 20.

Where a crossbow and a component to be attached to the crossbow together have a sliding joint assembly, the crossbow and the component may be easily attached or disconnected. While the sliding joint assembly disclosed in the figures and described herein includes the particular shapes of tongue 42 and slot 100, other complementary-shaped structures may be used. For example, a traditional dovetail design could be used, wherein the tongue and slot have trapezoidal shapes. One of skill in the art will also appreciate that either the crossbow stock or the component to be attached to it can have one portion of a sliding joint assembly, and the other must have the other portion of the sliding joint assembly. The one portion and the other portion constitute a complete sliding joint assembly. Thus, together, the stock and the component have a sliding joint assembly.

Figure 8:
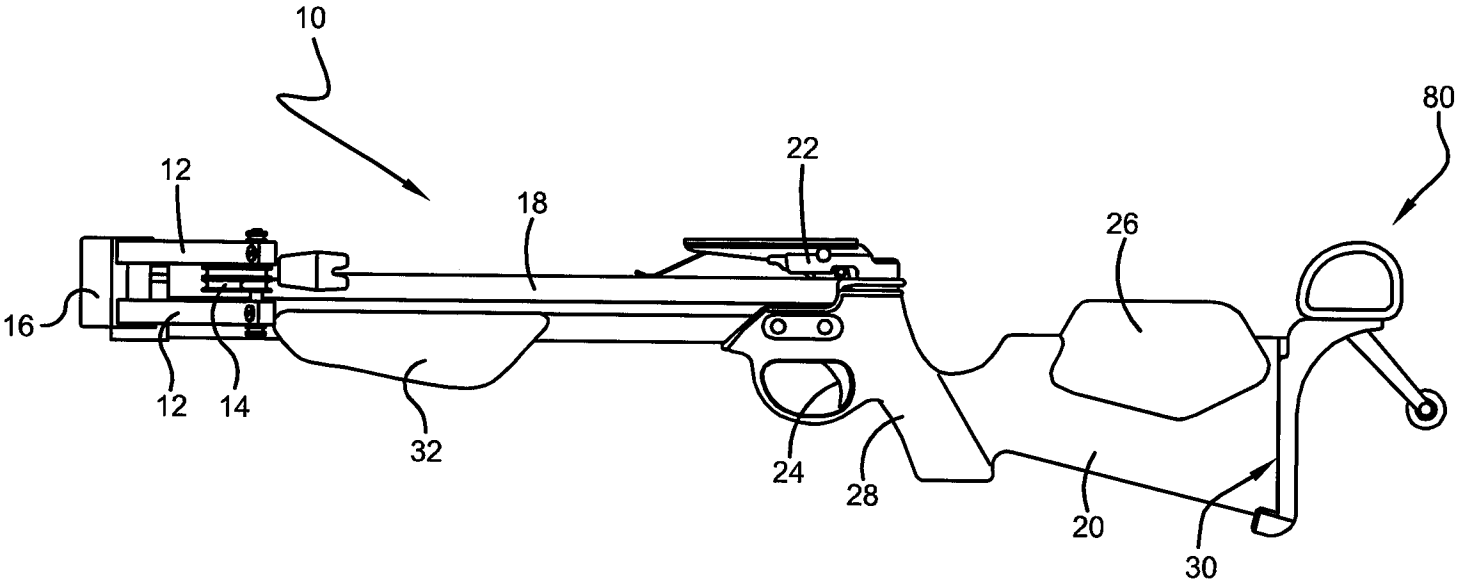
FIG. 8 is a side elevational view showing a crank assembly completely installed on the stock of a crossbow.

Having complementary-shaped pieces of a sliding joint assembly, the crank assembly 80 is easily installed on stock 20. To install crank assembly 80, an archer first removes the recoil pad 34, or any other item, from stock 20 in order to expose the entire tongue 42. Then, the crank assembly 80 is positioned below the stock 20, so that it is generally below the toe region 38. Then, tongue 42 on stock 20 is brought into alignment with slot 100 on crank assembly 80. Once so aligned, the sliding surfaces 102 on crank assembly 80 are in light contact with sliding surface 48 on the butt end 30 of stock 20, and crank assembly 80 is moved generally upward. Sliding surfaces 48, 102 and the tongue 42 and slot 100 guide the movement of the crank assembly 80 relative to the stock 20, and keep the crank assembly 80 and stock 20 in close contact. Crank assembly 80 is moved upward until the ledges 98 on crank assembly 80 contact overhang 52 on stock 20, as shown in FIG. 8. Also, in that position, the end stop 104 of crank assembly 80 contacts the stock 20, with the curved stop surface 108 generally wrapping around the bottom surface 56 of stock 20. Such an arrangement, with ledges 98 contacting overhang 52 and end stop 104 contacting stock 20, prevents further movement of crank assembly 80 toward heel region 36 in the axial direction of the sliding joint assembly (extending generally in the axis connecting heel region 36 and toe region 38). The complementary shapes of tongue 42 and slot 100 preclude any off-axis movement, such as side-to-side rotation, or rotation away from stock 20.

FIG. 8 shows the crank assembly in the completely installed position, and is thus attached to stock 20. In such a position, the surface 96 abuts protrusion 50, ledges 98 abut overhang 52, sliding surfaces 102 abut sliding surface 48, ball catch 46 engages recess 110, and end stop 104 abuts bottom surface 56. Thus, a secure attachment is formed between crank assembly 80 and stock 20, so that crank 82 could be used to cock crossbow 10.

Crank assembly 80 may easily be removed from stock 20. Once an archer has completed the cocking process, he will likely wish to remove crank assembly 80 from crossbow 10 in order to further prepare for shooting. To accomplish the removal, the archer simply presses on the crank assembly 80 in the opposite direction from which it was installed, which pressing easily overcomes the resistance of ball catch 46. Once crank assembly 80 has been removed, recoil pad 34 may be reinstalled. Because recoil pad 34 includes structure similar to crank assembly 80, including a slot for receiving tongue 42, its installation is similar to that of crank assembly, with the archer aligning the slot in recoil pad 34 with tongue 42, and then sliding the two components together. Of course, the structure and methods described herein are equally applicable to any other component that could be attached to a crossbow, such as, for example, if a butt plate were used in place of a recoil pad.

Figure 9:
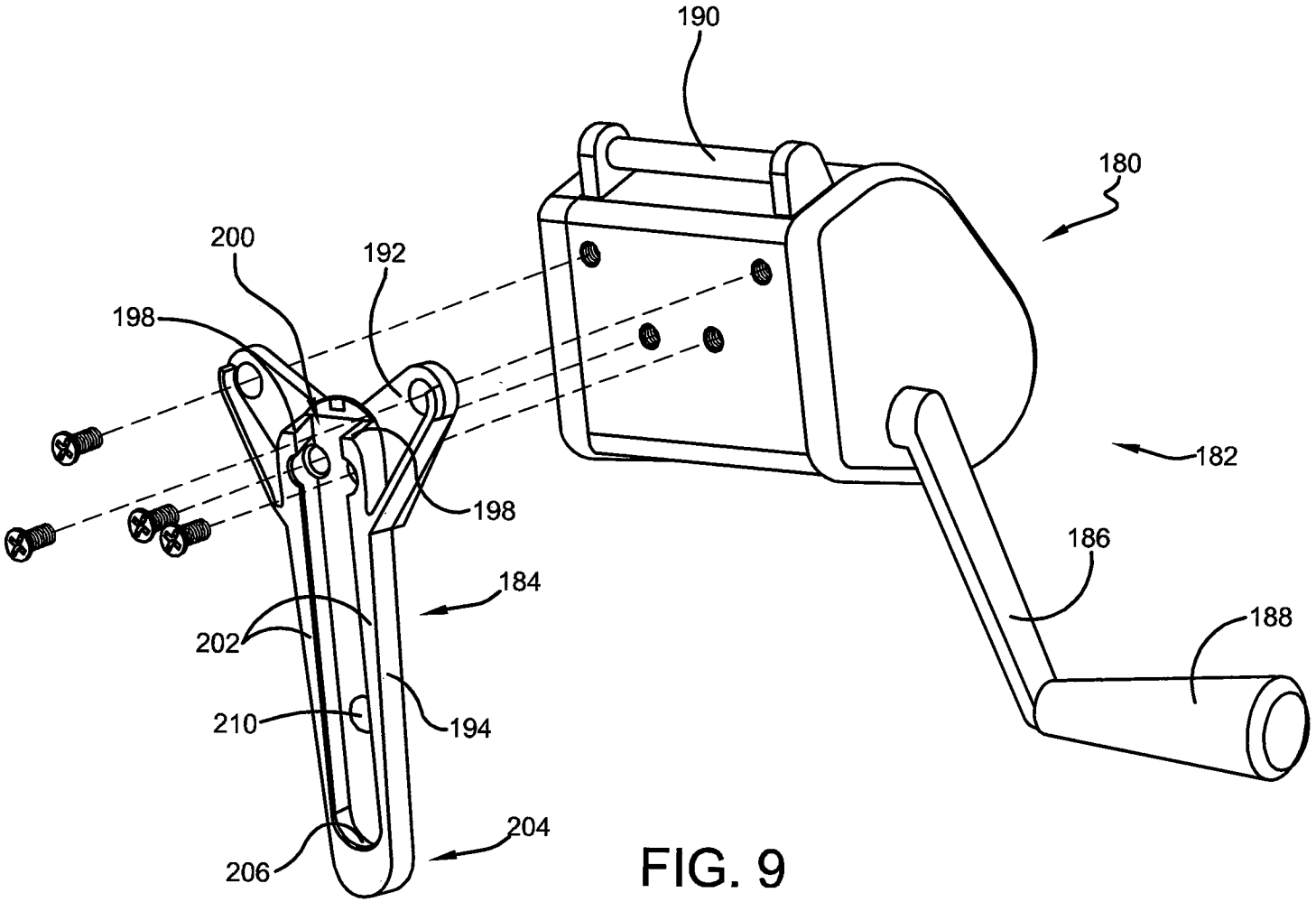
FIG. 9 is an exploded view of an alternative crossbow-cocking crank assembly having features of the present invention.

A crank assembly 180 having an alternative configuration is shown in FIG. 9. Crank assembly 180 includes two main components, a crank 182 and an attachment body 184. Crank 182 can be any useful type of crank, including a ratcheting crank, and includes a crank arm 186 and a handle 188. A guide bar 190 re-directs the movement of crank leads (not shown) which may extend out of crank 182 and attach to and pull on the bowstring of a crossbow.

Attachment body 184 includes a crank arm 192 supporting crank 182 and a sliding joint assembly arm 194 for attaching crank assembly 180 to the crossbow stock. Crank arm 192 is attached to crank 182, such as by screws. Sliding joint assembly arm 194 supports or includes a portion of a sliding joint assembly (the complementary shaped portion to what is provided on stock 20) for connecting the crank assembly 180 to the stock 20 of crossbow 10. Arm 194 includes ledges 198 extending therefrom, which are separated by a slot 200 defined in arm 194. The shape of slot 200 is designed to correspond with the shape of tongue 42 on stock 20. Thus, the tongue 42 may be slidably received in slot 200. Sliding surfaces 202 extend downwardly from ledges 198 to an end stop 204 which includes a stop surface 206. Arm 194 also includes a recess 210 for mating with the ball of the ball catch 46 incorporated into tongue 42 on stock 20.

While the present disclosure and the associated figures relate to the archery field (particularly, crossbows), it will be apparent that the teachings disclosed herein may be relevant and applied to any stock, including firearm stocks.

Thus, it should be evident that a crossbow and crank constructed as described herein accomplishes the objects of the invention and otherwise substantially improves the art.

What is claimed is:

1. A stock adapted to be connected to another item having a first portion of a sliding joint assembly, wherein:
- the first portion includes a slot;
- the stock comprises a butt end that: (1) comprises a tongue defining a second portion of the sliding joint assembly; (2) includes a sliding surface; and, (3) extends from a heel region to a toe region;
- a protrusion extends from the sliding surface proximate the heel region
- the protrusion defines an overhang; and,
- the second portion is adapted to engage the first portion on the other item.

2. The stock of claim 1 further comprising:
- a ball catch provided in the tongue portion;
- a ball;
- a recess formed in the other item; and,
- wherein the ball is received in the ball catch and recess.

3. The stock of claim 1 wherein the other item is a recoil pad.

4. The stock of claim 1 wherein the other item is a crank assembly comprising:
- a crank; and,
- an attachment body that comprises the slot of the first portion.

5. The stock of claim 1 wherein the stock is part of a crossbow.

6. A crossbow for use with a component having a first portion of a sliding joint component, comprising:
- a stock having a butt end, and a second portion of the sliding joint component formed on the butt end; and,
- a recoil pad, wherein the recoil pad includes the first portion of the sliding joint assembly.

7. The crossbow of claim 6 further comprising:
- a crack assembly comprising: a crank; and, an attachment body that comprises a surface similar to the first portion of the sliding joint assembly; and,
- wherein when the recoil pad is removed from the stock, the surface of the attachment body engages the second portion of the sliding joint assembly to attach the crank assembly to the stock.

8. The crossbow of claim 6 wherein:
- the first portion includes a slot; and,
- the second portion includes a tongue that is received in the slot to attach the recoil pad to the stock.

9. The crossbow of claim 6 further comprising:
- a ball catch provided in the first portion;
- a ball;
- a recess formed in the second portion; and,
- wherein the ball is received in the ball catch and recess.

10. A crank assembly for use with a crossbow stock having a first portion of a sliding joint assembly, wherein:
- the crank assembly comprises: (1) a second portion of the sliding joint assembly adapted to engage the first portion to form the sliding joint assembly; (2) a crank; and, (3) an attachment body for attaching the crank assembly to the stock; and,
- the attachment body includes a sliding joint assembly arm that: (1) includes the second portion; (2) includes one or more sliding surfaces; and, (3) includes an end stop.

11. The crank assembly of claim 10 wherein:
- the first portion includes a slot; and,
- the second portion includes a tongue that is received in the slot to attach the crank assembly to the stock.

12. The crank assembly of claim 10 further comprising:
- a ball catch provided in the second portion;
- a ball;
- a recess formed in the first portion; and,
- wherein the ball is received in the ball catch and recess.

13. A crank assembly for use with a crossbow stock having a first portion of a sliding joint assembly, wherein:
- the crank assembly comprises: (1) a second portion of the sliding joint assembly adapted to engage the first portion to form the sliding joint assembly; (2) a crank; and, (3) an attachment body for attaching the crank assembly to the stock; and,
- the attachment body includes a sliding joint assembly arm that comprises: (1) the second portion; (2) one or more sliding surfaces; (3) a first surface; and, (4) a ledge defined between the first surface and the one or more sliding surfaces.

14. The crank assembly of claim 13 wherein:

the first portion includes a slot; and, the second portion includes a tongue that is received in the slot to attach the crank assembly to the stock.

15. The crank assembly of claim 13 further comprising:

a ball catch provided in the second portion;

a ball;

a recess formed in the first portion; and, wherein the ball is received in the ball catch and recess.

* * * * *